US008616411B1

(12) United States Patent
St. Germain

(10) Patent No.: US 8,616,411 B1
(45) Date of Patent: Dec. 31, 2013

(54) COLLAPSIBLE TUBE RETAINING DEVICE

(76) Inventor: Jon P. St. Germain, Elk River, MN (US)

( * ) Notice: Subject to any disclaimer, the term of this patent is extended or adjusted under 35 U.S.C. 154(b) by 647 days.

(21) Appl. No.: 12/731,142

(22) Filed: Mar. 24, 2010

Related U.S. Application Data

(60) Provisional application No. 61/162,840, filed on Mar. 24, 2009.

(51) Int. Cl.
*B65D 35/32* (2006.01)

(52) U.S. Cl.
USPC ..... 222/99; 222/93; 222/106

(58) Field of Classification Search
USPC ..... 222/99, 100, 106, 93, 192; 132/311–318, 248–250
See application file for complete search history.

(56) References Cited

U.S. PATENT DOCUMENTS

| | | | | | |
|---|---|---|---|---|---|
| 1,733,114 | A | * | 10/1929 | Brennan | 132/314 |
| 1,990,929 | A | * | 2/1935 | Bonham | 132/314 |
| 2,411,336 | A | * | 11/1946 | Reiter | 132/248 |
| 2,492,594 | A | | 12/1949 | Renouf | |
| 2,732,845 | A | * | 1/1956 | Winkler | 132/250 |
| 2,903,162 | A | | 9/1959 | Regan | |
| 3,045,685 | A | * | 7/1962 | Cormier | 132/250 |
| 3,204,646 | A | * | 9/1965 | Chamberlin | 132/250 |
| 3,628,696 | A | | 12/1971 | Dulken | |
| 4,428,389 | A | * | 1/1984 | Sanchez Cordero | 132/325 |
| 4,508,239 | A | * | 4/1985 | Rozzen | 222/39 |
| 4,515,171 | A | * | 5/1985 | Thibodeaux | 132/250 |
| 4,576,314 | A | | 3/1986 | Elias et al. | |
| 4,778,082 | A | | 10/1988 | Vitelle | |
| 4,796,783 | A | * | 1/1989 | Paulson | 222/80 |
| 5,094,362 | A | | 3/1992 | Dickens | |
| 5,102,014 | A | | 4/1992 | Yanagisawa et al. | |
| 5,277,335 | A | | 1/1994 | Okami et al. | |
| 5,344,049 | A | * | 9/1994 | MacDonald | 222/107 |
| 5,480,065 | A | | 1/1996 | Powers | |
| 5,558,107 | A | * | 9/1996 | Kim | 132/228 |
| 5,558,250 | A | | 9/1996 | Manders | |
| RE35,587 | E | | 8/1997 | Okamura et al. | |
| 5,732,722 | A | * | 3/1998 | Mortvedt | 132/325 |
| 5,884,812 | A | | 3/1999 | Stawowski | |
| 5,979,706 | A | * | 11/1999 | Grussmark | 222/93 |
| 6,253,931 | B1 | | 7/2001 | Starkey | |
| 6,374,830 | B1 | * | 4/2002 | Afeworki | 132/250 |
| 6,409,047 | B1 | | 6/2002 | Tanaka | |
| 6,419,115 | B1 | | 7/2002 | Logan, Jr. | |
| 6,547,104 | B1 | * | 4/2003 | Wilkinson | 222/192 |
| 6,685,057 | B1 | | 2/2004 | Sullivan | |

(Continued)

*Primary Examiner* — Paul R Durand
*Assistant Examiner* — Donnell Long
(74) *Attorney, Agent, or Firm* — DuFault Law Firm, P.C.; Dustin R. DuFault

(57) ABSTRACT

A device for use in dispensing the contents of a collapsible tube comprises a hollow cylindrical member for winding about the tube. The cylindrical member includes an elongated slot for receiving a tail portion of the collapsible tube, as well as a plurality of notches positioned along a periphery of a first end of the cylindrical member. An elastic flexible tether anchors to a second end of the cylindrical member. The tether is positionable between at least one of the plurality of notches contained within the first end of the cylindrical member. After winding, the tether is stretched and positioned between a selected notch, thereby securing the tether to the first end of the cylindrical member and retaining the thusly wound tube in a selected position. The hollow cylinder may also include a floss dispensing member positionable therein, as well as act as a storage compartment.

6 Claims, 4 Drawing Sheets

(56) References Cited

U.S. PATENT DOCUMENTS

| | | | | |
|---|---|---|---|---|
| 7,021,497 | B2 * | 4/2006 | Hara | 222/106 |
| 7,201,172 | B2 * | 4/2007 | Nanda | 132/309 |
| 7,243,663 | B1 * | 7/2007 | Einstein et al. | 132/314 |
| 2004/0237995 | A1 * | 12/2004 | Mualem et al. | 132/311 |
| 2006/0255065 | A1 * | 11/2006 | Crosby et al. | 222/102 |
| 2007/0169788 | A1 * | 7/2007 | Liao | 132/248 |

* cited by examiner

FIG 5
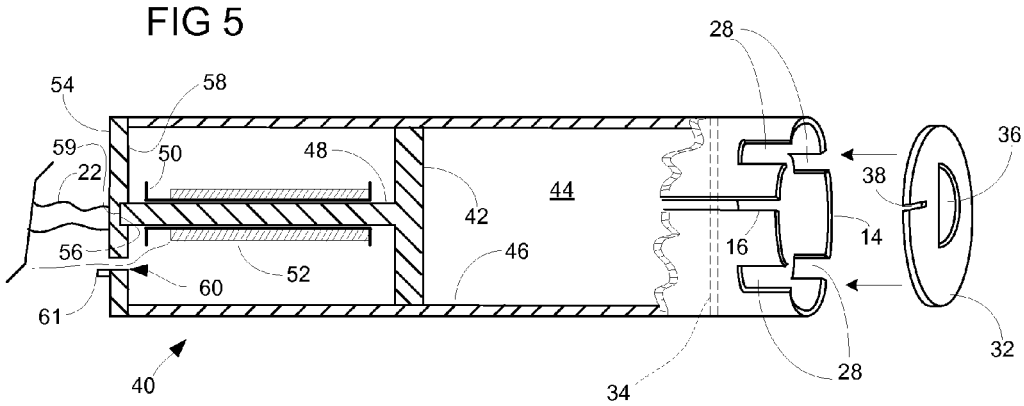
FIG 6
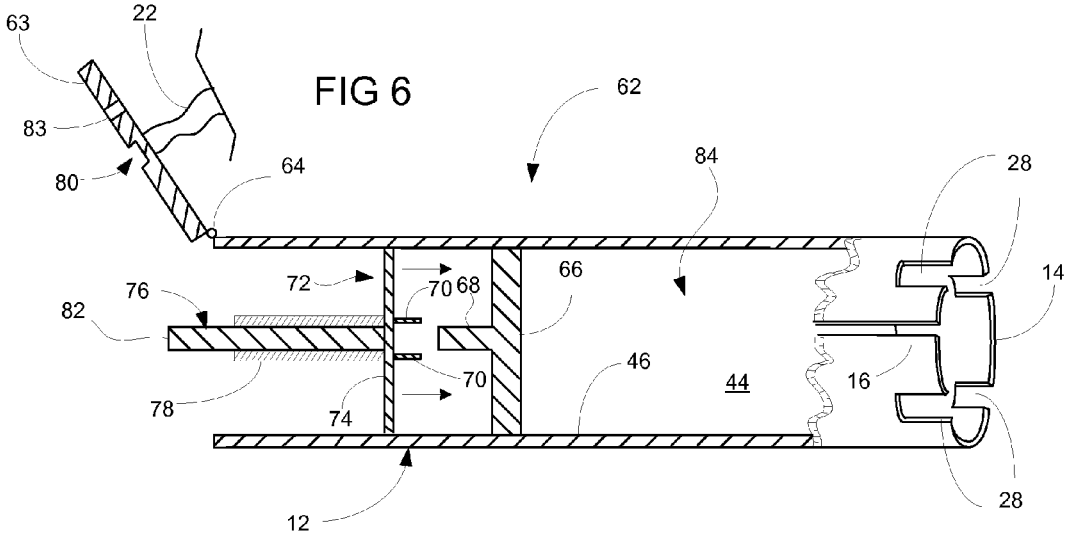
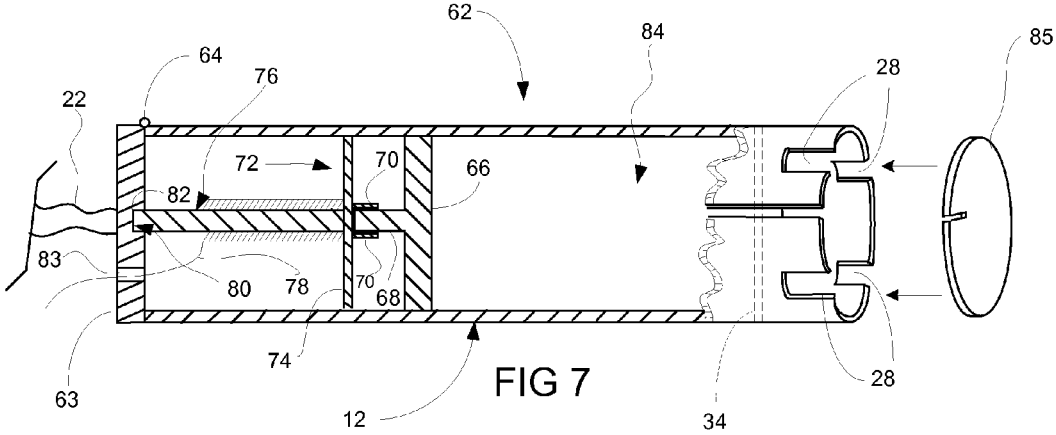
FIG 7

FIG 8
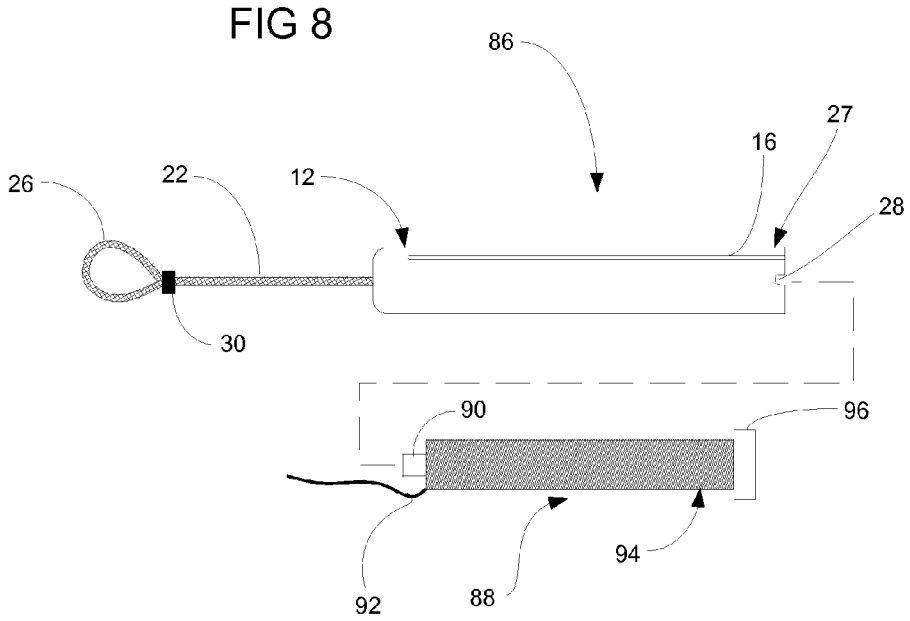
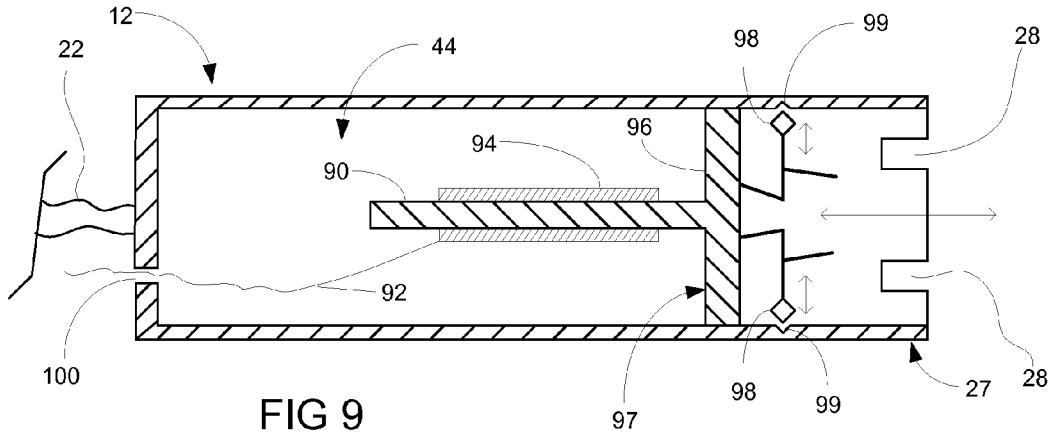
FIG 9

COLLAPSIBLE TUBE RETAINING DEVICE

CROSS-REFERENCE TO RELATED APPLICATION(S)

This application claims the benefit of U.S. Provisional Patent Application No. 61/162,840 entitled COLLAPSIBLE TUBE RETAINING DEVICE, filed on 24 Mar. 2009, which is hereby incorporated herein by reference.

BACKGROUND OF THE INVENTION

Dispensing or collapsible tube containers have been used in the art for a number of years as a means to store and dispense various semi-viscous compositions, including both industrial and household compositions. An exemplary semi-viscous household composition would include toothpaste. From a product manufacturer perspective, dispensing tubes are a very simple solution to product packaging in that they are inexpensive, adaptable to high volume manufacturing, available in many shapes and sizes and can be customized with product names and branding strategies. Typically, the construction of such tubes is made from thin-walled foil or resilient plastic which is sealed on one end and containing a sealable opening at an opposite end. Generally, the sealable opening includes a cap positionable thereover. Upon removing the cap, the semi-viscous composition is urged through the opening to be dispensed at various intervals. This can be accomplished by the user removing the cap and squeezing the tube with their hand until the desired amount of the viscous composition is dispensed and then the cap is replaced. As the material from the tube is intermittently evacuated, the body of the dispensing tube partially collapses, consequently diminishing the ability of the user to squeeze that portion of the tube in subsequent material dispensing. As the tube becomes further emptied it becomes more and more difficult to remove the remaining material. In addition to the problematic removal of material, the appearance of the dispensing tube as it is partially filled looks unkept and takes up unnecessary space during storage. It is therefore desirable to urge the semi-viscous material to the front of the dispensing tube so that the remaining tube is fully filled at all times during the dispensing process.

There exist in the art several examples of others trying to accomplish this goal. For example, the following U.S. Patents each generally suggest the use of a rigid key for winding a collapsible tube: U.S. Pat. Nos. 2,492,594; 2,903,162; 5,094,362; 5,558,250; and 5,884,812. Such devices, however, have not gained wide acceptance, ostensibly due to the fact that they are each quite bulky and are difficult to use, especially if one wants to limit the amount of space in storing the toothpaste tube, especially with so many other toiletry products available and used in current market. There therefore exists a need to provide a lightweight, easy to use device which does not take up an inordinate amount of storage space when used in conjunction with a collapsible tube.

BRIEF SUMMARY OF INVENTION

The following product description aims to provide key advantages over the existing art to overcome collective shortcomings that have hindered adoption to any given solution to this problem. The objectives of the design are to provide an inexpensive, intuitive approach to systematically gather material in the tube to allow compression of a full tube while capturing the spent portion of the dispensing tube and provide a retention mechanism of the spent tube that can withstand compressive force during material removal and be adaptable to the number of wraps of spent tubing that have accumulated. The present invention generally comprises a main cylinder body with an elastic retention strap secured to a terminal end of the main cylinder body. The elastic retention strap has a formed loop on the free end that serves as a grip point during attachment with the opposing end of the main cylinder body as well as the ability to hang the assembly if desired. There is a larger diameter nub at the base of the loop that serves as an engagement mechanism with the main cylinder body. The sealed end of the partially emptied dispensing tube is placed in a slot in the main cylinder body. The slot may be dimensioned to be slightly larger that the dispensing tube end, or the slot may be constructed to be slightly smaller than the dispensing tube so it fits snugly when positioned therein for a frictional fit. The spent portion of the dispensing tube is manually wrapped around the exterior of the main cylinder body by rotating the main cylinder body relative to the dispensing tube. By this action, excess material is pushed to the forefront of the dispensing tube filling the other portions of the tube that were once partially filled. Once sufficient material has been redistributed in the partially filled tube to plump up or fill-out the remaining tube to a full expanded state, the elastic retaining strap is stretched across the wrapped tubing on the main cylinder body and secured to the opposite side. There are a series of notches cut into the main cylinder body that accommodate the disposing of the strap therebetween, with the larger diameter nub securing the elastic retaining strap to the main cylinder body.

An alternative embodiment of the described invention includes the addition of a bobbin style dental floss insert that may be disposed within the interior of the main cylinder body in order to provide easy access to dental floss or other string-like materials that would generally accompany the dispensing tube. Functionally, the operation of the tube clip is identical to that described above with the addition of the bobbin placed within the interior of the cylinder. The floss or other string-like material is threaded through an aperture contained on an end of the main cylinder body, preferably the end that the elastic retaining strap is affixed. The aperture includes a small tab molded in the main cylinder body that serves to cut the string material and secure it in position after use. The bobbin style insert is removeable once empty and a full bobbin may be reinserted to re-fill the system.

Another embodiment of the described invention provides a storage compartment within the interior of the main body cylinder in a similar fashion as the bobbin system described above. The storage compartment can accommodate other materials or devices that would routinely be used in conjunction with activity associated with the dispensing tube that is being secured. Typical applications may include fluoride tablets or whitening strips in the case of a toothpaste dispensing tube. In this configuration, the main cylinder body would have an opening on the end of the affixed elastic retaining strap to access the storage container. The opening mechanism may be a hinged cover or a rotatable opening to provide the means of access and closure.

BRIEF DESCRIPTION OF THE DRAWINGS

The following figures are used herein in conjunction with the specification to assist in understanding the invention. The Figures are as follows:

FIG. 5 is a partial cut-away view of a first alternative embodiment of the retaining device of the present invention.

FIG. 6 is a partial cut-away view of a second embodiment of the retaining device of the present invention.

FIG. 7 is a partial cut-away view of the second embodiment of the retaining device of the present invention.

FIG. 8 is a perspective view of a third alternative invention employing a first mechanism for containing dental floss.

FIG. 9 is a perspective view of a third alternative invention employing a second mechanism for containing dental floss.

DESCRIPTION OF THE INVENTION

Figure 1:
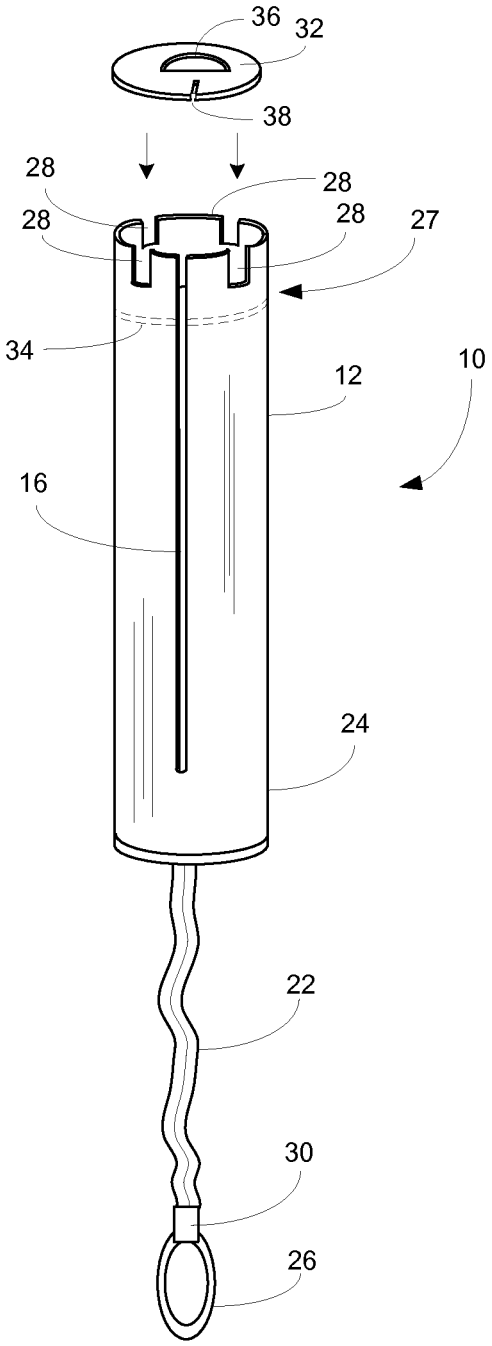
FIG. 1 is a perspective view of a collapsible tube retaining device of the present invention.

A collapsible tube retaining device is generally indicated at 10 in FIG. 1. The device 10 generally comprises a main body 12 which is used to coil the spent tubing during the dispensing process. The main body 12 is preferably cylindrical in shape, but may also be elliptical or rectangular without impacting the intended product performance. The main body 12 is preferably constructed of a polymer material, such as polyethylene, in order to be lightweight, resistant to staining and general wear and tear. Additives may be incorporated in the material in order to provide luminescence of various colors and graphical designs such as logos or color schemes. The main body 12 preferably includes a thin-walled portion 14, is hollow on the interior and suitable for injection molding to form its shape. The main body 12 features a slot 16 for receiving the tail end 18 of the dispensing tube 20. The slot 16 extends longitudinally across the main body 12 through the main body wall 14. The slot 16 is formed such that upon inserting the tail end 18 of the dispensing tube 20 through the slot 16, the walls of the tube 20 frictionally engage the surfaces of the slot 16, and facilitate a secure attachment of the device 10 at all times during placement and use. While the slot 16 preferably extends through the main body 12, it is also within the scope of the present invention that the slot 16 extend only partially through the wall 14 of the main body 12 to receive at least a portion of the tail end 18 of the dispensing tube 16. However configured, the slot 12 is meant to facilitate attachment of the device 10 to the dispensing tube tail 18.

A securement strap 22 for engaging and disengaging during the process of wrapping and securing spent tubing is affixed to a first end 24 of the main body 12 by either insert molding or a mechanical interlock. The securement strap 22 is uniquely designed to have a length that is shorter in its unsecured state relative to its secured state, and is preferably constructed of an elastic material such as shock cord, rubber or other elastic material. On the free end of the securement strap 22 there is preferably a formed loop 26 that provides a safe grip point to be used to secure the strap 22 to the opposing side of the main body 12 as well as a means to hang the device 10, whether it be attached to a dispensing tube or not, if desired. To receive the strap 22, positioned within the cylindrical wall 14 on an opposing second end 27 of the main body are a series of notches 28. There are preferably from one to six notches 28 formed within the wall 14 of the main body 12 to secure the strap 22 independent of the rotated orientation of the main body 12 relative to the device 10. Each notch 28 extends from the second end 27 towards the first end 24 of the main body 12 and is wide enough to accommodate the width of the securement strap 22. To secure the free end of the loop 26 to the main body 12, a nub of material 30 is positioned adjacent the formed loop 26. The nub 30 is of a greater diameter than the width of the notches 28. To releasably secure the free end of the securement strap 22 to the main body 12, the strap 22 is stretched by the user and disposed between a selected notch 28. Upon the user releasing the strap 22, which at this time is in a state of tension, the elasticity thereof urges the strap 22 towards a more relaxed position, but is prevented from doing so by the engagement of the nub 30 with an inner surface of the cylindrical wall 14 of the main body.

Optionally, a cap 32 can be provided which is insertable through the second end 27. The cap 32 includes a diameter only slightly lesser than the inner diameter of the cylindrical wall 14, thereby permitting a snug fit. The cap 32 may affix to the main body 12 by a variety of means known in the art including, but not limited to, frictional fit, snap fit, threaded fit or hinged fit, along dashed lines 34 as illustrated in FIG. 1. Upon fitting the cap 32 onto the device, the internal cavity can act as a storage bin to place suitable items therein related to the use of the collapsible tube 20. This may include dental floss, whitening strips, fluoride tablets, vitamins, toothpicks and the like. The cap 32 may optionally include an aperture 36 positioned therethrough for obtaining or retrieving the contents storable within the inner cavity of the main body 12, and as a means to grasp the cap 32 to remove it. It may also be advantageous, though not essential, to provide a slot 38 in the cap 32 which coincides and cooperates with the elongated slot 16 of the main body 12, thereby permitting the tail 18 of the dispensing tube 20 to be unhindered when positioning the tube 20 on the device 10.

Figure 2:
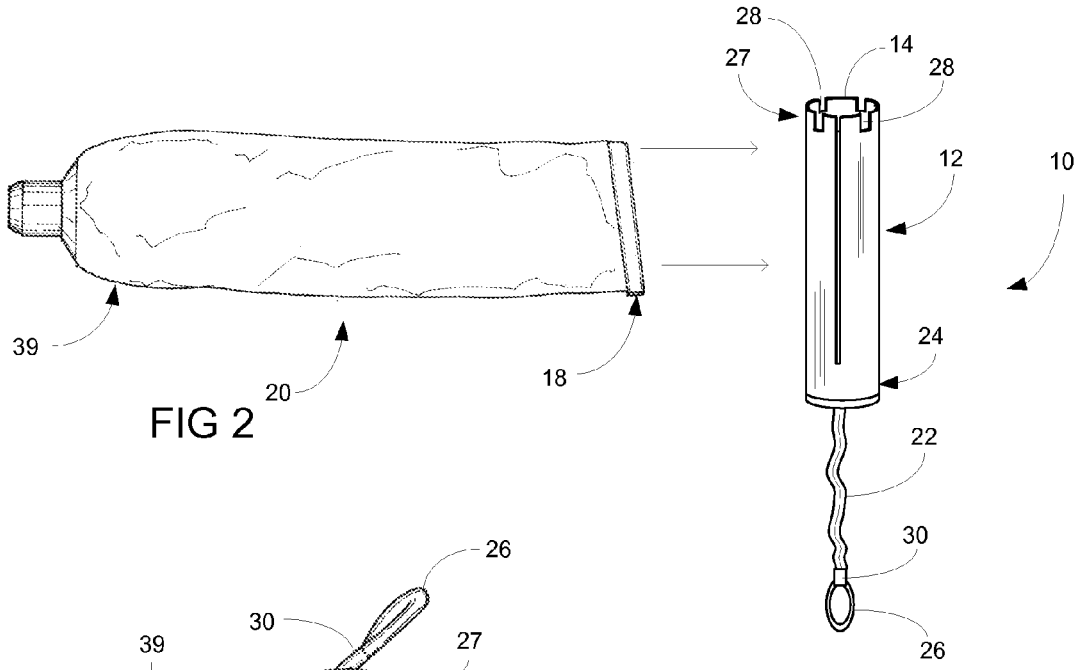
FIG. 2 is a perspective view of the device of the collapsible tube retaining device of the present invention alongside a collapsible tube.
Figure 3:
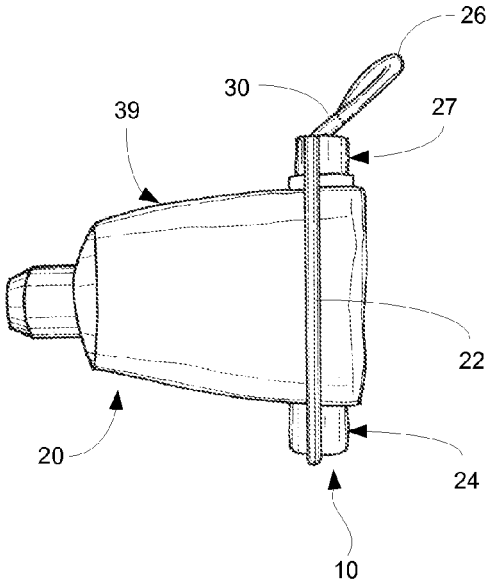
FIG. 3 is a perspective view of the collapsible tube wrapped about the retaining device of the present invention.
Figure 4:
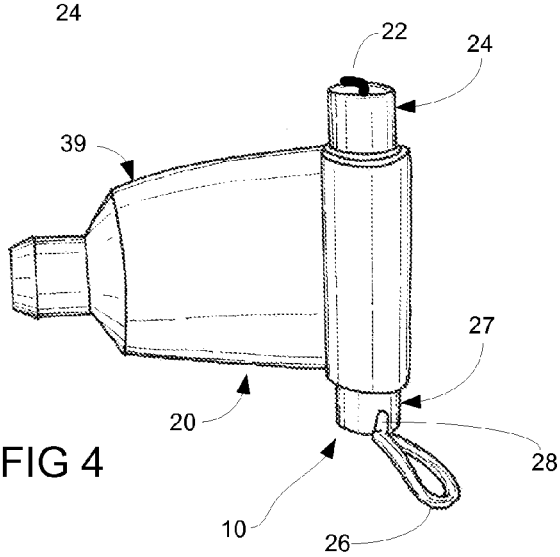
FIG. 4 is an opposing perspective view of FIG. 3 illustrating the collapsible tube wrapped about the retaining device of the present invention.

Referring now to FIG. 2, in operation the device 10 is positioned proximate the tube of toothpaste 20 such that the tail end 18 of the tube 20 is aligned with the slot 16 of the device 10. The tail end 18 is then inserted within the slot 16, and the device 10 is rotated relative to the tube 20 such that the tube 20 is wound about an outer surface of the main body cylinder 12. In so doing, the semi-viscous material within the tube proximate the tail end is urged toward the opposite end of the tube. Upon the forward portion 39 of the tube 20 being filled to its capacity, the securement strap 22 is stretched over the tube 20 and within an adjacent selected notch 28 to secure the strap 22 in a state of tension, and prevent unwinding of the tube 20, as is illustrated in FIGS. 3 and 4. After further contents of the tube are later dispensed, the strap 22 can be released from the selected notch 28 by pulling and stretching the strap thereover, thereby allowing further winding of the device 10 relative to the tube 20 to again urge the semi-viscous material toward the forward portion 39 of the tube, whereupon the strap 22 can again be affixed to a selected notch 28 in the same manner as previously described to retain the tube 20 at its new position. The securing of the strap 22 in the manner thus described provides a tensile resistive force that is insensitive to the number of wraps of tubing about the main body, and yet easily releasable and resistant to tubing unravel during the dispensing process.

Referring now to FIGS. 5, 6, 7, 8 and 9, alternative embodiments are illustrated with each incorporating into the main body 12 structure which provides for the dispensing of dental floss or other string-like material that may be associated with the use of the dispensing tube 20. It should be noted that to the extent that similar parts of the embodiment 10 are also included in the following alternative embodiments, like references will be used.

As illustrated in FIG. 5, a first alternative embodiment 40 includes a disk 42 positioned within an internal cavity 44 of the cylinder 12 and mounted to an inner wall 46. A shaft 48 extending longitudinally from the disk 42 supports a replaceable bobbin 50 or spool containing floss 52 disposed thereon. The first end 24 of the main body 12 includes a removable cap 54 which may affix to the main body 12 by a variety of means known in the art including, but not limited to, frictional fit, snap fit, threaded fit or hinged fit. The cap 54 includes a recessed portion 56 positioned within an inner wall 58 for receiving a proximal end 59 of the shaft 48 to provide additional support thereto. Dental floss 52 spooled onto the bobbin 50, which is disposable upon the shaft 48, is taken from the spool and lead through an aperture 60 contained within the removable cap 54. While not essential to practice the present invention, a small cutting device 61 may be optionally positioned on an outer surface of the cap 54 proximate to the aperture 60 for cutting the dental floss 52 once a satisfactory amount has been removed from the spool 50. Once the supply of dental floss 52 contained on the bobbin 50 has been exhausted, the mechanism 40 can be reloaded by removing the cap 54 from the cylinder 12, and then removing the bobbin 50 from the shaft 48. Upon depleting the supply of dental floss, the old bobbin is removed and a fresh bobbin with a full supply of floss can then be disposed upon the shaft, with an end of the floss being passed through the aperture 60 before closing the cap. The device is then again suitable for use.

Referring now to FIGS. 6 and 7, a second alternative embodiment 62 is illustrated. The second alternative embodiment includes an openable cap 63 connected to the main body 12 by means of a hinge 64 in which the elastic strap 22 is mounted. It should be noted that it is well within the scope of the present invention that the cap 63 can be attached to the main body by other means including threaded or frictional engagement. Positioned within the main body cavity 44 is a floor member 66 having a centrally positioned stud 68 extending therefrom towards the first end 24 of the main body 12. The stud 68 acts as a male end for coupling with a female end 70 of a bobbin member 72. The bobbin member 72 includes a disk 74 from which extends a central longitudinal shaft 76 for disposing dental floss 78 thereon. To provide support to the bobbin member 72, the cap 63 also includes a recessed portion 80 for receiving a terminal end 82 of the shaft 76 when the cap 63 is closed. As best illustrated in FIG. 6, to load a fresh bobbin of thread, the cap 63 is opened, the bobbin assembly 72 is slid inside the main body 12, and the floss 80 is threaded thru a dispensing hole 83 in the cap 63. The cap 63 is then closed and the bobbin assembly 72 as secured within the main body 12, as best illustrated in FIG. 7. Once the supply of floss 78 is exhausted, the bobbin assembly 72 can be removed by reversing the steps described and a new bobbin assembly 72 loaded.

It should be noted that it is well within the scope of the present invention to place the floor 66 at varying positions within the inner cavity 44 to either accommodate different sized bobbins 72 or to provide for a storage area 84 which is sealable by a repositionable cap 85 in much the same manner as described herein with regard to the first alternative embodiment 40.

Referring now to FIGS. 8 and 9, a third alternative embodiment 86 is illustrated in which alternative floss mechanisms dispose within the cavity 44 of the main body 12 through the second end 27 thereof. A first floss mechanism 88 includes a shaft 90 for disposing the floss 92 directly thereon, or for supporting a bobbin of thread 94. The shaft 90 has a diameter lesser than the inner diameter of the main body 12. The mechanism 88 further includes a disk or bar 96 for supporting the shaft 90. The diameter of the disc 96 is such to permit entry of the mechanism 88 into the inner cavity 44 of the main body 12 with the disc 96 slidably engageable with the inner wall 46. The disc 96 is held in place by frictional engagement with the inner cylindrical wall, as illustrated in FIG. 8. Alternatively, and as illustrated in FIG. 9, a second alternative floss mechanism 97 includes depressible resilient tabs 98 which engage a groove 99 contained within the inner cylindrical wall 46. When the mechanism 97 is positioned within the inner cavity 44, the tabs 98 are urged into the groove 99, thereby locking the mechanism 97 into place. To remove the mechanism 97, the user simply urges the tabs 98 inward, thereby disengaging the tabs 98 from the groove 99, and the mechanism 97 is removable from the inner cavity 44.

The floss 94 is threaded and retrievable through an aperture 100 in much the same manner as disclosed with regard to the first alternative embodiment 40. Both mechanisms 88 and 97 are reversible to allow the floss 92 or bobbin 94 to be replaced once empty and may be accomplished by either a friction fit or preferably snap fit with tabs (not shown) formed in the bobbin that may be depressed in order to facilitate release.

It is recognized there are multiple variations beyond what are outlined in the detailed description to accomplish the objectives set forth by the current invention. Those skilled in the art will appreciate the intended scope of invention is to provide a simple, elegant, low cost method of managing the spent portion of a dispensing tube with a main body to wrap the excess tube and securing with an elastic strap that can be repositioned during the intermittent dispensing process. Further alternative embodiments provide additional utility of the device for the convenience of the user. As such, although the present invention has been described with reference to preferred and alternative embodiments, workers skilled in the art will recognize that changes may be made in form and detail without departing from the spirit and scope of the invention.

The invention claimed is:

1. A device for use in dispensing the contents of a collapsible tube, the device comprising:

a hollow cylindrical member containing surfaces defining an elongated slot for receiving a tail portion of the collapsible tube;

surfaces defining a plurality of spaced-apart notches positioned along a periphery of a first end of the cylindrical member;

an elastic flexible tether having a proximal end thereof anchored to a second end of the cylindrical member, the tether being positionable within at least one of the plurality of notches contained within the first end of the cylindrical member, whereupon positioning the tail portion of the collapsible tube within the elongated slot and winding the cylindrical member relative to the tube, the tube partially collapses urging the contents toward an open end thereof, whereafter stretching and positioning the flexible tether, positioning a terminal portion of the tether over the tube and within a selected notch, the terminal portion of the tether engages the selected notch, thereby securing the tether to the first end of the cylindrical member and retaining the thusly wound tube in a selected position;

a first cap member having surfaces defining an aperture therethrough, the first cap member attachable to the second end of the cylindrical member, the tether anchored to an outer surface of the first cap member; and a dispensing mechanism positionable within the hollow cylindrical member, the dispensing mechanism capable of dispensing dental floss, the dispensing mechanism comprising:

a base member positioned within the cylindrical member transverse to the longitudinal axis of the cylindrical member;

a stud extending from the base member; and a bobbin for supplying the floss, the bobbin comprising:

a support member positionable within the cylindrical member transverse to the longitudinal axis of the cylindrical member;

a centrally positioned female member extending from a first side of the support member for receiving the stud; and a centrally positioned spindle extending from a second side of the support member for containing the supply of floss, wherein inserting the bobbin through the first end of the cylindrical member, outer surfaces of the support member engage inner surfaces of the cylindrical member, wherein the female member receives the stud to secure the bobbin within the cylindrical member, wherein the floss is disposable through the aperture contained within the first cap member to be retrievable by the user.

2. The device of claim 1 wherein the tether includes a nub positioned proximate to the terminal portion, the nub being of greater width than any width of the plurality of notches, wherein positioning the terminal portion of the tether within the selected notch and releasing the tether, the nub is urged against an inner surface of the cylindrical member to secure the tether to the first end of the cylindrical member.

3. The device of claim 1 wherein the first cap member further includes positioned on an inner surface thereof a central recessed portion for receiving a terminal end of the spindle upon attaching the cap member to the cylindrical member.

4. The device of claim 1 wherein the tether is not engaged with the tube while winding the cylindrical member relative to the tube.

5. A device for use in dispensing the contents of a collapsible tube, the device comprising:

a hollow cylindrical member containing surfaces defining an elongated slot for receiving a tail portion of the collapsible tube;

a securing mechanism connected to the cylindrical member for securing the cylindrical member to the dispensing tube to retain the tube in a selected position upon winding the tube about the cylindrical member; and a dispensing mechanism positionable within the hollow cylindrical member, the dispensing mechanism capable of dispensing dental floss, the dispensing mechanism comprising:

a first cap member attachable to an end of the cylindrical member, the first cap member including surfaces defining an aperture to dispose the floss therethrough and a centrally positioned recessed portion contained on an inner surface thereof;

a base member positioned within the cylindrical member transverse to the longitudinal axis of the cylindrical member;

a stud extending from the base member; and a bobbin for supplying the floss, the bobbin including a support member positionable within the cylindrical member transverse to the longitudinal axis of the cylindrical member, a centrally positioned female member extending from a first side of the support member for receiving the stud, and a centrally positioned spindle extending from a second side of the support member for containing the supply of floss, a terminal end of the spindle disposable within the recessed portion of the first cap, wherein positioning the bobbin within the cylindrical member, outer surfaces of the support member engage inner surfaces of the cylindrical member, wherein the female member receives the stud to secure the bobbin within the cylindrical member, wherein the floss is disposable through the aperture contained within the first cap member to be retrievable by the user.

6. The device of claim 5 wherein the securing mechanism comprises:

surfaces defining a plurality of spaced-apart notches positioned along a periphery of a first end of the cylindrical member; and an elastic flexible tether having a proximal end thereof anchored to a second end of the cylindrical member, the tether being positionable within at least one of the plurality of notches contained within the first end of the cylindrical member, whereupon positioning the tail portion of the collapsible tube within the elongated slot and winding the cylindrical member relative to the tube, the tube partially collapses urging the contents toward an open end thereof, whereupon stretching and positioning a terminal portion of the tether over the tube and within a selected notch, the terminal portion of the tether engages the selected notch, thereby securing the tether to the first end of the cylindrical member and retaining the thusly wound tube in a selected position.

* * * * *